US009562683B2

(12) United States Patent
St. Louis

(10) Patent No.: US 9,562,683 B2
(45) Date of Patent: Feb. 7, 2017

(54) APHLOGISTIC BURNER

(71) Applicant: Daniel Mark St. Louis, Wichita, KS (US)

(72) Inventor: Daniel Mark St. Louis, Wichita, KS (US)

( * ) Notice: Subject to any disclaimer, the term of this patent is extended or adjusted under 35 U.S.C. 154(b) by 430 days.

(21) Appl. No.: 14/006,677

(22) PCT Filed: Sep. 23, 2012

(86) PCT No.: PCT/US2012/056783

§ 371 (c)(1),
(2) Date: Sep. 22, 2013

(87) PCT Pub. No.: WO2013/048914

PCT Pub. Date: Apr. 4, 2013

(65) Prior Publication Data

US 2014/0093830 A1 Apr. 3, 2014

Related U.S. Application Data

(60) Provisional application No. 61/539,050, filed on Sep. 26, 2011.

(51) Int. Cl.

| | |
|---|---|
| ***F23D 14/12*** | (2006.01) |
| ***F23D 14/16*** | (2006.01) |
| ***F23D 14/02*** | (2006.01) |

(52) U.S. Cl.

CPC ..... *F23D 14/12* (2013.01); *F23D 14/02* (2013.01); *F23D 14/16* (2013.01)

(58) Field of Classification Search

CPC ..... F23D 14/12

(Continued)

(56) References Cited

U.S. PATENT DOCUMENTS 3,155,142 A * 11/1964 Stack ..... F23C 99/00 431/328
4,643,667 A * 2/1987 Fleming ..... F23D 14/16 431/328

(Continued)

*Primary Examiner* — Avinash Savani
(74) *Attorney, Agent, or Firm* — Melanius D'Souza

(57) ABSTRACT

A burner which is capable of producing zero NOx and zero CO by passing a thoroughly mixed stream of air and fuel at an appropriate air-to-fuel ratio to maintain a temperature below the NOx forming threshold through a radiant combustion zone. The radiant combustion zone provides the intense radiant energy required to initiate and to complete the combustion process. The burner comprises an Air-Fuel Ratio Attainment Means (AFRAM) and an Air-Fuel Mixing Means (AFMM) in fluid communication with the AFRAM to thoroughly mix the air and fuel to provide a readily combustible mixture, and one or more Radiant Combustion Zone (RCZ), and a Combustion Initiation Means (CIM) located in a combustion-initiation-contact position to initiate the combustion in the RCZ. A high velocity section or a porous flow permeable membrane is used as a combustion guard to prevent flameback from occurring. A second porous flow permeable membrane may be used as a flame trap for containing the infrared radiation within the radiant combustion zone. The burner can be used in commercial and domestic appliances and space heaters. At lower excess air the burner can be operated as an ultra low NOx burner.

29 Claims, 7 Drawing Sheets

(58) Field of Classification Search
USPC ..... 431/326, 7, 354, 353
See application file for complete search history.

(56) References Cited

U.S. PATENT DOCUMENTS

| | | | | | |
|---|---|---|---|---|---|
| 4,752,213 | A * | 6/1988 | Grochowski | F23D 14/02 | 431/328 |
| 5,361,750 | A * | 11/1994 | Seel | F23D 14/62 | 126/91 A |
| 5,476,375 | A * | 12/1995 | Khinkis | F23C 6/045 | 122/18.4 |
| 2001/0014436 | A1 * | 8/2001 | Lemelson | F23N 1/022 | 431/12 |
| 2009/0136879 | A1 * | 5/2009 | Anderson | F23C 13/00 | 431/2 |
| 2009/0241942 | A1 * | 10/2009 | Schwank | F23D 14/12 | 126/91 A |

* cited by examiner

APHLOGISTIC BURNER

RELATED APPLICATIONS

This application claims priority from U.S. Provisional Patent Application No. 61/539,050 filed on Sep. 26, 2011 and from International Application No. PCT/US 12/56783 filed on Sep. 23, 2012.

FIELD OF THE INVENTION

The present invention relates to No-NOx Burners and their applications. It relates particularly to Aphlogistic (flameless) non-surface No-NOx Burners and their applications.

BACKGROUND

Fossil fuels are burned throughout the industrialized world to generate heat for heating homes and commercial buildings, for power generation, for use in industrial processes, and for many other applications.

In recent years there has been increasing concern over the NOx produced by burning fossil fuels in conventional type burners. In fact governments in many regions of the world are introducing and enforcing ever more restrictive regulation with regards to NOx production.

To reduce the NOx produced from burning fossil fuels, a special type of burner can be used. Such a burner is referred to generally as a low NOx burner. These special burners are effective in reducing the NOx produced from burning fossil fuels, but they still emit significant amounts of NOx. Furthermore, they are very complex and expensive.

There is therefore a pressing need for an inexpensive No-NOx burner which produces essentially zero (relative to ambient NOx) NOx during the combustion of natural gas or other fuel. Such No-NOx burners can be used in domestic, commercial, and industrial applications.

The reason conventional burners produce NOx is that temperatures within the flame far exceed the temperature required for NOx to be formed from atmospheric oxygen and nitrogen. Further, the peak temperatures of the flame change from well in excess of 3,000 degrees F. to much lower temperatures when combustion is complete. This rapid quenching assures that the unstable NOx compounds within the flame are frozen into metastable compounds of NOx.

To prevent the formation of NOx in the first place, a special burner is required which will promote complete combustion at a much lower temperature so that the adiabatic flame temperature is reduced.

Several approaches to achieving low NOx combustion currently exist. One approach is to use a catalytic burner; however, as is well known in the art, catalytic burners are very expensive and are prone to failure from numerous causes such as catalyst poisoning or particulate blinding, etc.

Another approach is to use surface combustion type burners. Low NOx burners using surface combustion technology are currently commercially available from manufacturers such as Alzeta Corporation which markets them under the Duratherm trademark (see http://www.alzeta.com/products/duratherm.asp). However the surface combustion technology is expensive and problematic and prone to failure and is limited to low capacity per sq. ft.

Still another approach to attaining low NOx combustion is Flue Gas Recirculation (FGR) technology. FGR technology is very expensive and complicated.

All of these technologies can attain low NOx performance; however none of these technologies can achieve zero-NOx performance. Therefore, there is a pressing need for a simple and inexpensive burner that can achieve low NOx performance and even zero NOx performance.

This application discloses a No-NOx burner which is capable of achieving low and even zero NOx from the flameless non-surface combustion of fossil fuel such as natural gas, propane, butane, etc.

SUMMARY

In a first embodiment, a flameless burner capable of zero-NOx and zero-CO comprises an Air-Fuel Ratio Attainment Means (AFRAM) and an Air-Fuel Mixing Means (AFMM) in fluid communication with the AFRAM to thoroughly mix the air and fuel to provide a readily combustible mixture, and one or more Radiant Combustion Zone (RCZ), and a Combustion Initiation Means (CIM) located in a combustion-initiation-contact position to initiate the combustion in the RCZ. The AFRAM is connected to a source of fuel and to a source of air, the AFRAM having means to achieve the required proportions of fuel and air therethrough. The RCZ comprises one or more flow passages having a fluid flow inlet in fluid communication with the supply plenum of the AFMM and a hot gas discharge opening. During operation, the RCZ provides the intense radiant energy required to initiate and complete the combustion process and to promote and enhance flame-less non-surface combustion in the RCZ.

In a second embodiment of the flameless burner, the fluid communication between the supply plenum of the AFMM and the RCZ is provided by one or more high velocity fluid flow passages. Each passage has a cross-sectional flow area which is sufficient to create a gas velocity greater that the flame velocity to prevent pre-ignition in the supply plenum of the AFMM.

Another embodiment of the flameless burner further comprises a flow permeable structure (FPS) located in the fluid flow inlet of the RCZ to prevent pre-ignition in the supply plenum of the AFMM. The FPS may have through flow passages or may be a ceramic honeycomb with through flow passages or may be a porous ceramic structure with random through flow passages, or may be a wire mesh structure.

Another embodiment of the flameless burner further comprises an IR radiation reflector in the RCZ. The IR radiation reflector is located proximate to or at the flow discharge opening of the RCZ to intensify the IR radiation in the RCZ. The IR radiation reflector may be a porous FPS or a peripheral flow baffle.

In yet another embodiment of the flameless burner, the RCZ is configured as a flat, hollow disc which comprises a flat bottom which contains the fluid flow inlet for fluid communication with the supply plenum of the AFMM, a flat top, and a cylindrical wall. The hot gas discharge opening is a plurality of orifices on the cylindrical wall of the hollow disc. Further, the AFRAM may comprise an air eductor.

DETAILED DESCRIPTION OF PREFERRED EMBODIMENTS

Figure 1A:
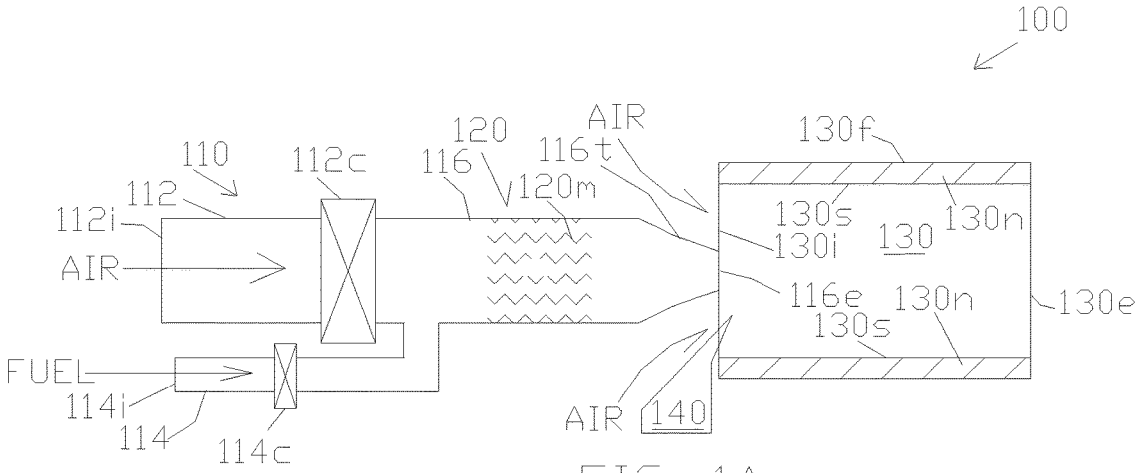
FIG. 1A is a representation of the aphlogistic No-NOx burner 100 described herein in operation with a provision for secondary air.

The following is a list of term used in this disclosure and their specific meanings as applied herein.

Flame: As used herein the word "flame" may also mean combustion with no radiation that is visible to the human eye.

Aphlogistic Burner: A fuel-burner in which the combustion of the fuel occurs without the presence of a visible flame.

Burner supply plenum: The burner supply plenum is the chamber which feeds air and fuel to the premix type burner element. A well designed burner supply plenum provides well mixed air and fuel and also provides very even flow and very even pressure distribution to the burner.

Flameless combustion cell: A flameless combustion cell is one of a plurality of small passages or cavities for promoting and enhancing flameless combustion in the burner.

Flame back: Flame back is the movement of the hot products of combustion from the combustion chamber into the supply plenum. This is undesirable as it will cause combustion in the supply plenum.

Glow back: Glow back is the process of heating the combustion guard from the hot end towards the cold end so that the fuel-air mixture in the burner supply plenum attains the auto ignition temperature. Glow back must be controlled so that the glow does not reach the burner supply plenum. If glow back occurs, the fuel and air will be ignited and will combust within the supply plenum; this situation is undesirable.

Radiation Combustion Zone (RCZ): The RCZ is a partially enclosed space which glows with intense infra-red radiation wherein flameless non-surface combustion takes place.

Non-Surface Combustion: Non-Surface Combustion is the phenomenon wherein the oxidation reactions involving the fuel and oxygen take place away from the containing surfaces and within the gas envelope (or boundary of the gaseous body) of the fuel and air mixture.

Infra-Red Radiation Reflector (IRRR): The IRRR is an element of a structure which reflects the infrared (IR) radiation in the RCZ so that the IR radiation is generally contained within the RCZ.

Combustion Trap: Any structure which contains one or more IR radiation reflecting surfaces while allowing combustion products to pass through.

Combustion Guard: Any structure that prevents glow back or flameback.

Porous Structure: Porous structure is a fluid permeable solid, which can be utilized as the combustion guard or the combustion trap. The porous structure can be a matrix with randomly oriented flow-passages or an extrusion with regularly oriented flow passages or a wire mesh.

Peripheral Flow Baffle (PFB): Is a flow disrupting element placed in the path of flow of a fluid. When a fluid encounters a PFB, its flow is re-directed around the periphery of the PFB.

Air-Fuel Ratio Attainment Means (AFRAM): The AFRAM is a device wherein the proportions of the fuel and the combustion air can be set so as to provide a combustible mixture. The AFRAM can have control means such as valves for active control of the proportion of the fuel and air. Alternately, the AFRAM could have fuel and air inlet ports which are pre-designed to allow the desired quantities of fuel and air into the AFRAM.

Air-Fuel Mixing Means (AFMM): The AFMM is a device wherein the fuel and air from the AFRAM are well mixed to sustain combustion in the RCZ. The AFMM could be a simple plenum or could be more elaborately designed with mixing vanes and other elements, both static or moving, to facilitate thorough mixing of the fuel and air.

Combustion Initiation Means (CIM): is any device such as a spark igniter, pilot flame, glow igniter or other device suitably positioned to initiate the combustion process in the RCZ.

Described herein is a burner which is capable of producing zero NOx and zero CO by passing a thoroughly mixed stream of air and fuel at an appropriate air/fuel ratio to maintain a temperature below the NOx forming threshold through a radiant combustion zone. During operation, the radiant combustion zone provides the intense radiant energy required to initiate and complete the non-surface combustion process. The temperature in the RCZ is controlled by the Air Fuel ratio which can be adjusted to attain low NOx and further zero NOx. The combustion temperature can be directly controlled with a suitable Air Fuel ratio. Increasing the excess air reduces the combustion temperature. This reduction in combustion temperature reduces the thermal NOx that is formed by the reaction of nitrogen with oxygen that normally takes place at the higher combustion temperatures of a conventional burner. Further the oxidation reaction does not produce carbon-monoxide and there is complete oxidation of the hydrocarbons to carbon-dioxide and water. The air and fuel provide the heat energy to keep the radiant combustion zone hot. The non-surface combustion according to this method is flameless and is capable of low NOx or no-NOx operation.

FIG. 1A is a representation of the aphlogistic No-NOx burner 100 described herein in operation. As shown herein, burner 100 comprises an Air-Fuel Ratio Attainment Means (AFRAM) 110, an Air-Fuel Mixing Means (AFMM) 120, a RCZ 130, and a Combustion Initiation Means (CIM) 140.

AFRAM 110 is configured as a Y-branched flow passage which has a larger flow passage 112 for the flow of the combustion air into AFRAM 110 and a smaller flow passage 114 for the flow of the fuel into AFRAM 110. Control means 112*c* is provided in flow passage 112 for the control of the quantity of combustion air that can enter AFRAM 110. Control means 112*c* could be a valve such as a butterfly valve, or a slide-gate valve, or any other manually or automatically activated fluid flow control device. A similar control means 114*c* is provided in flow passage 114 for the control of the quantity of fuel that can enter AFRAM 110. It is not necessary that active flow control elements be used as control means 112*c* and 114*c*. The control of fuel and air could be achieved by designing the dimensions and inlets of passages 112 and 114 so that pre-determined quantities of air and fuel are passively drawn into AFRAM 110. Thus AFRAM 110 is a means to attain the required quantities of fuel and air into burner 100. A volumetric Air to Fuel ratio (with natural gas as the fuel) in the range of 10 to 22 is sufficient to enable sustained combustion of the Fuel Air Mixture (FAM). The exact air-fuel ratio chosen for a particular application will be determined to attain the desired level of NOx or zero NOx and to meet other operating requirements as is well known in the art. For example, boiler operators may choose to operate with lower excess air to produce a low level of NOx within regulations while maximizing heating efficiency.

The two flow passages 112 and 114 of AFRAM 110 merge into a single outlet flow passage 116. During the operation of burner 100, fuel is drawn through inlet 114*i* in flow passage 114 and through control means 114*c*. The fuel mixes with air which is drawn through inlet 112*i* in flow passage 112 and through control means 112*c*. The fuel air mixture flows into outlet flow passage 116 from where it exits into AFMM 120 wherein it is mixed thoroughly.

AFMM 120 is configured as a flow passage with optional mixing vanes 120*m*. However, it will be obvious to persons having ordinary skill in the art that other mixing means such as a longer plenum or vanes or baffles (not shown) or multiple fuel ports may be provided within AFFM 120 to enhance the mixing of the fuel and air within AFMM 120. The fuel-air mixture exits AFMM 120 into the combustion guard.

The combustion guard is configured as a tapered outlet 116*t* on flow passage 116. The fuel-air mixture in tapered outlet 116*t* accelerates as it flows towards outlet 116*e* from which it emerges as a high velocity jet into RCZ 130. The high velocity of the fuel-air mixture as it exits outlet 116*e* acts as a combustion guard for preventing flame back of the flames into the AFMM 120.

RCZ 130 is configured as a flow passage 130*f* with an inlet 130*i* which may be larger than the outlet 116*e* of AFMM 120 and an open outlet 130*e*. Flow passage 130*f* is lined internally with insulation 130*n*. During operation of burner 100, the surface 130*s* of insulation 130*n* becomes hot and produces and reflects IR radiation to enable RCZ 130 to perform and function as a radiant non-surface combustion chamber. For efficient reflection of the IR radiation, it is recommended that the aspect ratio (length divided by hydraulic diameter) of flow passage 130*f* be between 1 to 10.

CIM 140 is located in a combustion-initiation-contact position to initiate the combustion of the fuel-air mixture as it exits AFMM 120. During the initial light-up phase of operation of aphlogistic burner 100, CIM 140 is activated to initiate the combustion of the fuel-air mixture as it exits though flow outlet 116*e* of tapered flow passage 116*t*. Initially, flames are produced after the outlet 116*e* of tapered flow passage 116*t*. However, after insulation 130*n* heats up, its internal surfaces 130*s* begin to produce IR radiation and also reflect the IR radiation produced by combustion and flameless combustion will occur within RCZ 130. At this stage of operation, the burner provides flameless non-surface combustion without any NOx and Carbon-monoxide being produced by the combustion process. It will obvious that burner 100 could be operated with less excess air to produce ultra-low NOX.

Figure 1B:
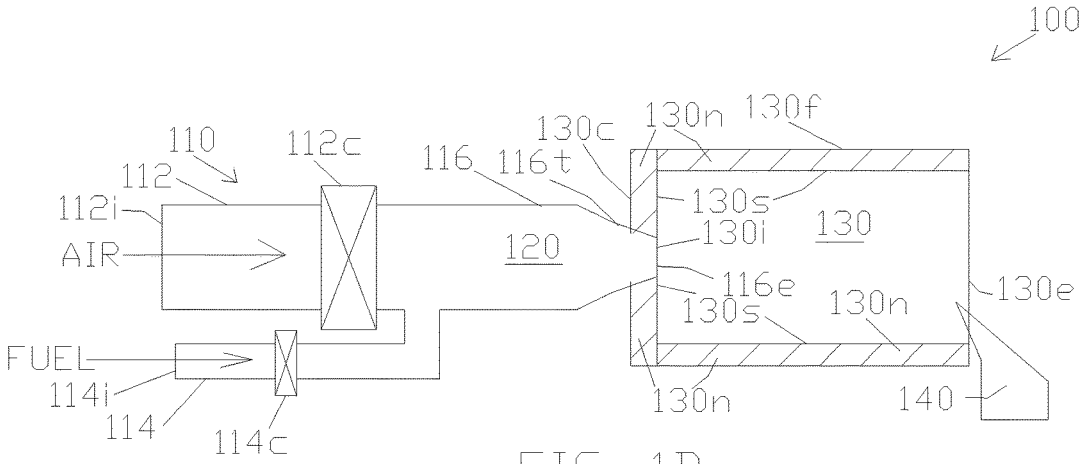
FIG. 1B is a representation of another embodiment of burner 100 of FIG. 1A without a provision for secondary air.

FIG. 1B is another embodiment of aphlogistic burner 100 wherein the first end of flow passage 130*f* has a closure 130*c* which has an inlet opening 130*i* which matches the outlet opening 116*e* of tapered flow passage 116*t*. Closure 130*c* is internally insulated with insulation 130*n* whose internal surface 130*s* acts as an IR radiation producer and reflector to promote flameless non-surface combustion within RCZ 130.

CIM 140 is located in a combustion-initiation-contact position at outlet 130*e* of RCZ 130 to initiate the combustion of the fuel-air mixture as it exits RCZ 130. During the initial light-up phase of operation of aphlogistic burner 100, CIM 140 is activated to initiate the combustion of the fuel-air mixture as it exits though flow outlet 130*e* of RCZ 130. Initially, flames are produced at the outlet 130*e* of RCZ 130. The high velocity of the fuel-air mixture out of outlet 116*e* acts as a combustion guard for preventing flame back of the combustion into the AFMM 120. After insulation 130*n* heats up, its internal surfaces 130*s* become hot and produce and reflect the IR radiation and flameless non-surface combustion starts to occur within RCZ 130. At this stage of operation, the burner provides flameless non-surface combustion with low or no NOx and Carbon-monoxide being produced by the non-surface combustion process.

Figure 2A:
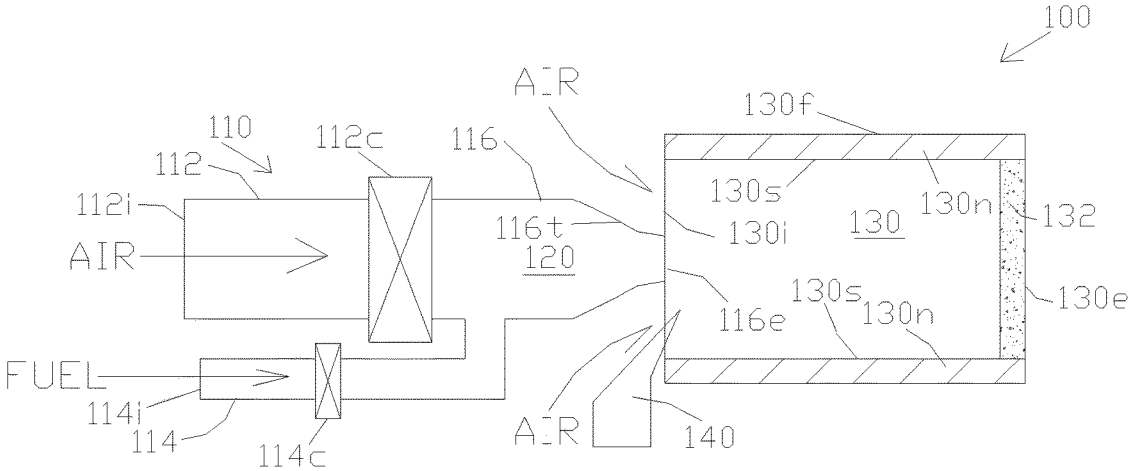
FIG. 2A represents another embodiment of aphlogistic burner 100 of FIG. 1A which has a flow permeable porous structure 132 located in its outlet 130*e*.

FIG. 2A represents another embodiment of aphlogistic burner 100 wherein the aphlogistic burner 100 of FIG. 1A has a flow permeable porous structure 132 located in its outlet 130*e*. Porous structure 132 could be a ceramic or metallic foam with random flow passages, or a metal wire mesh or a ceramic extrusion with regular flow passages. Porous structure 132 acts an additional IRRR to further produce IR radiation and contain and reflect the IR radiation within RCZ 130. Porous structure 132 enhances the radiation within RCZ 130, thus enabling burner 100 of FIG. 2A to achieve a lower firing capacity.

Figure 2B:
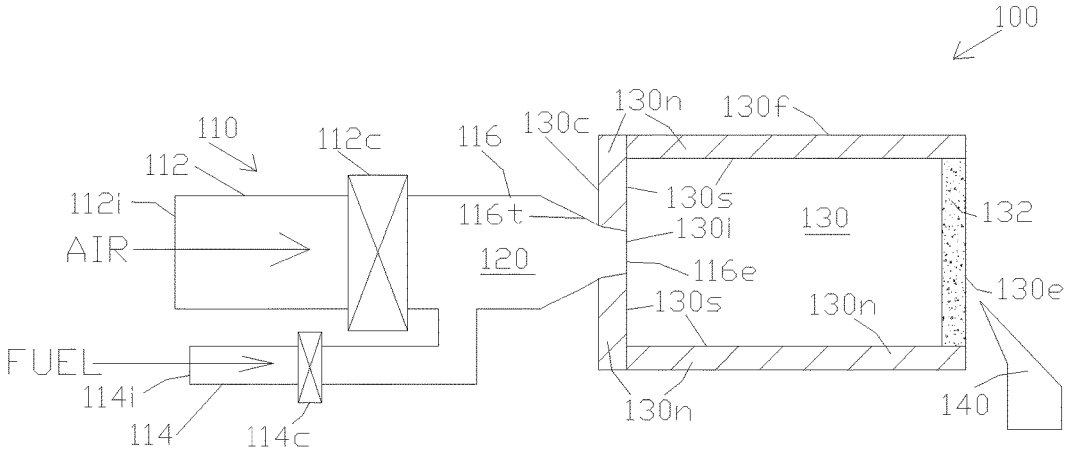
FIG. 2B represents another embodiment of aphlogistic burner 100 wherein the aphlogistic burner 100 of FIG. 1B has a flow permeable porous structure 132 located in its outlet 130*e*.

FIG. 2B represents another embodiment of aphlogistic burner 100 wherein the aphlogistic burner 100 of FIG. 1B has a flow permeable porous structure 132 located in its outlet 130*e*. Porous structure 132 could be a ceramic or metallic foam with random flow passages, or a metal wire mesh or a ceramic extrusion with regular flow passages. Porous structure 132 acts as an additional IRRR to further contain the IR radiation within RCZ 130. As described above, porous structure 132 enhances the radiation within RCZ 130, thus enabling burner 100 of FIG. 2B to achieve a low or no NOx at a lower firing capacity.

While the above embodiments of aphlogistic burner 100 use a high velocity fuel-air mixture to prevent flameback into AFMM 120, other means of preventing flameback can be practiced.

Figure 3A:
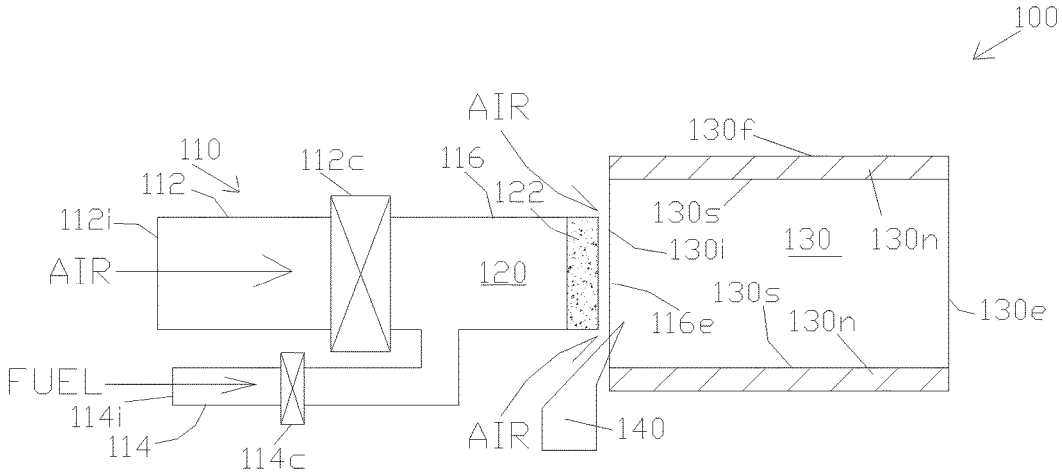
FIG. 3A represents another embodiment of aphlogistic burner 100 which has a combustion guard and a provision for secondary air.

FIG. 3A represents another embodiment of aphlogistic burner 100 wherein fuel-air mixture flow passage 116 is not tapered to create a high velocity fuel-air mixture stream. Flow passage 116 opens directly into RCZ 130 without a tapered outlet as in aphlogistic burner 100 of FIG. 1A. Therefore the velocity of the fuel-air mixture in passage 116 could be lower than the flame velocity. To prevent flameback, a porous structure 122 is inserted into outlet 116*e* of flow passage 116 to function as a combustion guard. Outlet 116*e* may be smaller than inlet opening 130*i* to provide an air gap for secondary air. To fire burner 100, CIM 140 initiates the combustion of the fuel-air mixture as it exits porous structure 122. The flames are contained within RCZ 130 and heat insulation 130*n*. When surfaces 130*i* of insulation 130*n* get hot they start producing and reflecting the IR radiation and flameless non-surface combustion begins to take place in RCZ 130.

Figure 3B:
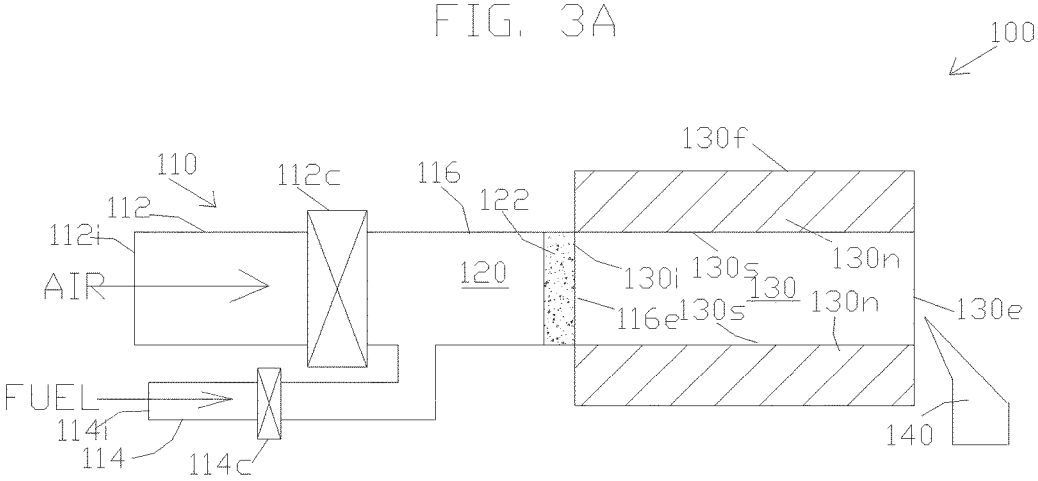
FIG. 3B represents another embodiment of aphlogistic burner 100 which has a combustion guard but does not have a provision for secondary air.

FIG. 3B represents another embodiment of aphlogistic burner 100 wherein fuel-air mixture flow passage 116 is not tapered to create a high velocity fuel-air mixture stream. Flow passage 116 opens directly into RCZ 130 without a tapered outlet as in aphlogistic burner 100 of FIG. 1A. A porous structure 122 is inserted into outlet 116*e* of flow passage 116 to function as a combustion guard. The operation of aphlogistic burner 100 of FIG. 3B is similar to that of aphlogistic burner 100 of FIG. 3A.

Figure 4A:
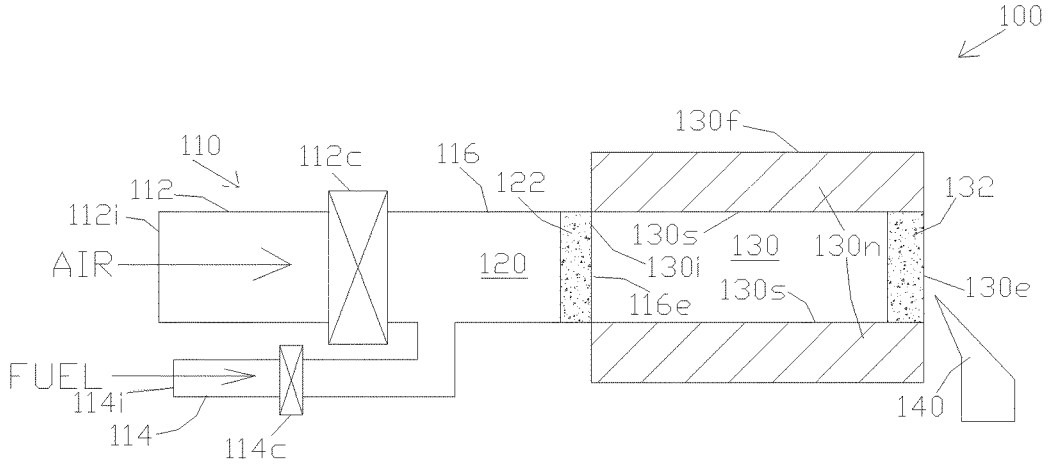
FIG. 4A represents yet another embodiment of aphlogistic burner 100 which has a combustion guard and a combustion trap but does not have a provision for secondary air.

FIG. 4A represents yet another embodiment of aphlogistic burner 100 wherein a first porous structure 122 is provided in outlet 116*e* of fuel-air mixture flow passage 116 to function as a combustion guard as described previously with respect to aphlogistic burner 100 of FIG. 3B. Outlet 116*e* opens directly into RCZ 300 without an air gap for secondary air. Furthermore, a second porous structure 132 is inserted into outlet opening 130*e* of flow passage 130*f* of RCZ 130 as described previously with respect to aphlogistic burner 100 of FIG. 2A. The operation of aphlogistic burner 100 of FIG. 4A is similar to that of aphlogistic burner 100 of FIG. 3B.

Figure 4B:
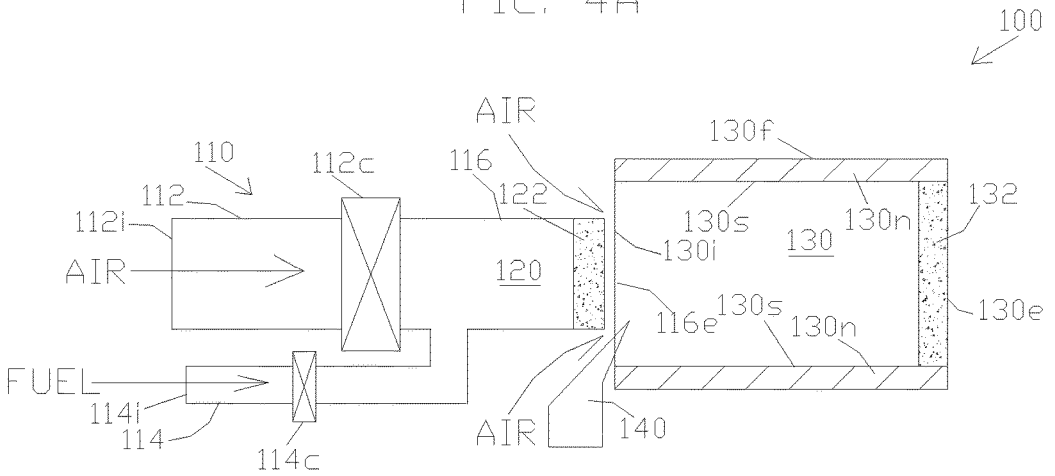
FIG. 4B represents yet another embodiment of aphlogistic burner 100 which has a combustion guard and a combustion trap and a provision for secondary air.

FIG. 4B represents yet another embodiment of aphlogistic burner 100 wherein a first porous structure 122 is provided in outlet 116*e* of FAM flow passage 116 to function as a combustion guard as described previously with respect to aphlogistic burner 100 of FIG. 3A. Outlet 116*e* may be smaller than inlet opening 130*i* to provide an air gap for secondary air. Furthermore, a second porous structure 132 is inserted into outlet opening 130*e* of flow passage 130*f* of RCZ 130 as described previously with respect to aphlogistic burner 100 of FIG. 2A. The operation of aphlogistic burner 100 of FIG. 4B is similar to that of aphlogistic burner 100 of FIG. 3A.

Figure 5:
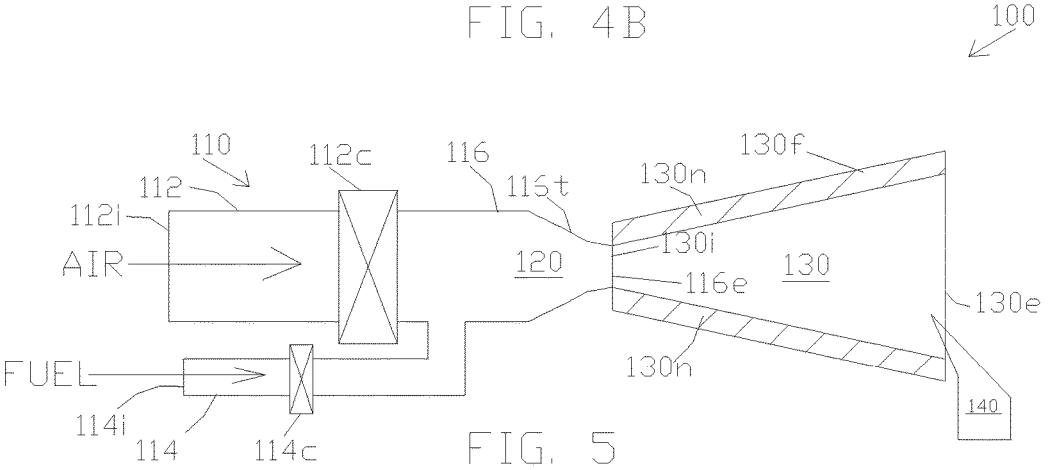
FIG. 5 represents an aphlogistic burner 100 wherein the flow passage 130*f* of Radiant Combustion Zone 130 is tapered outwards to allow for stable burner operation with a greater range of fuel-air mixture flowrates.

FIG. 5 represents an aphlogistic burner 100 wherein the flow passage 130*f* of RCZ 130 is tapered outwards to allow for stable burner operation with a greater range of fuel-air mixture flowrates. This prevents the combustion gases from being blown out of passage 130*f* when the fuel-air mixture flowrate is increased to provide greater heat output. The active area wherein combustion takes place shifts axially within the tapered flow-passage depending on the flowrate of the fuel-air mixture. The operation of aphlogistic burner 100 of FIG. 5 is similar to that of aphlogistic burner 100 of FIG. 1B. It will be obvious that a tapered flow passages could be provided in any of the previously described aphlogistic burners of FIGS. 1A to 4B.

Figure 6:
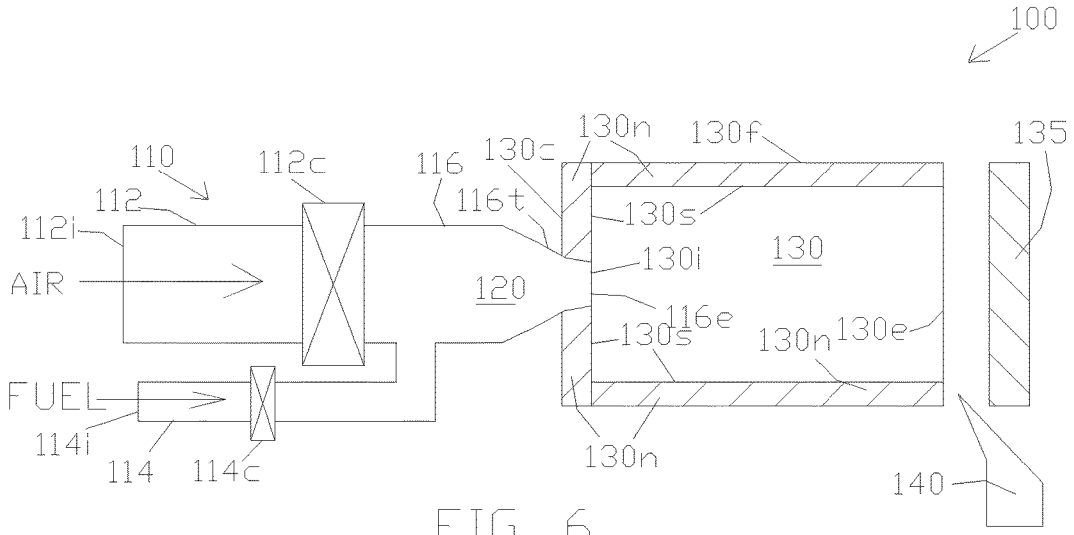
FIG. 6 represents another aphlogistic burner 100 wherein a peripheral flow baffle 135 is provided at the outlet of Radiant Combustion Zone 130 to reflect the infrared radiation back into Radiant Combustion Zone 130.

FIG. 6 represents another aphlogistic burner 100 wherein a peripheral flow baffle (PFB) 135 is provided at the outlet of RCZ 130. PFB 135 reflects the IR radiation back into RCZ 130. The products of combustion flow out of RCZ 130 in a radial direction in the gap between outlet 130*e* of RCZ 130 and PFB 135. This arrangement may be useful for example when it is necessary to shield other parts of the user's appliance from radiative heat effects. The operation of aphlogistic burner 100 of FIG. 6 is similar to that of aphlogistic burner 100 of FIG. 1B. It will be obvious that a PFB could be provided in any of the previously described aphlogistic burners of FIGS. 1A to 4B.

Figure 7:
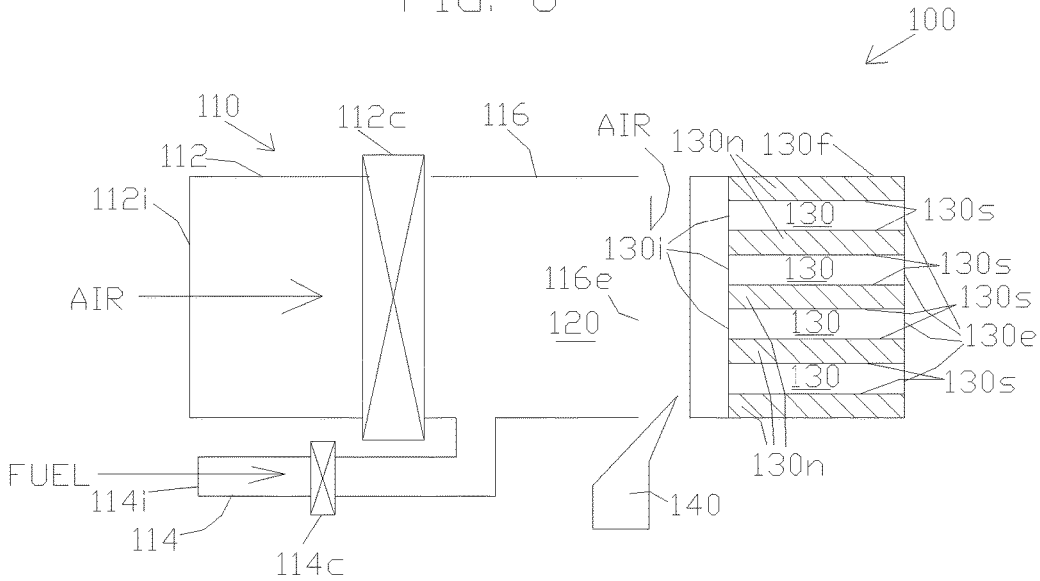
FIG. 7 represents an aphlogistic burner 100 wherein a plurality of Radiant Combustion Zones 130 is provided in parallel to increase the infrared radiation reflection surface area.

FIG. 7 represents an aphlogistic burner 100 wherein a plurality of RCZs 130 is provided in parallel to increase the IR radiation producing and reflecting surface area. This results in a potentially shorter RCZ and is useful in applications where space is limited or could allow the burner to operate at a lower capacity while still producing low or no-NOx The operation of aphlogistic burner 100 of FIG. 7 is similar to that of aphlogistic burner 100 of FIG. 1A. It will be obvious that other means of increasing the IR radiation surface area such as honeycomb structure parallel to the flow, or parallel plates or reticulated ceramic foam or open coil of refractory material and other such means could be used in aphlogistic burner 100 of FIG. 7. It will be obvious also that additional surface area as discussed above could be provided in any of the previously described aphlogistic burners of FIGS. 1A to 4B.

Figure 8A:
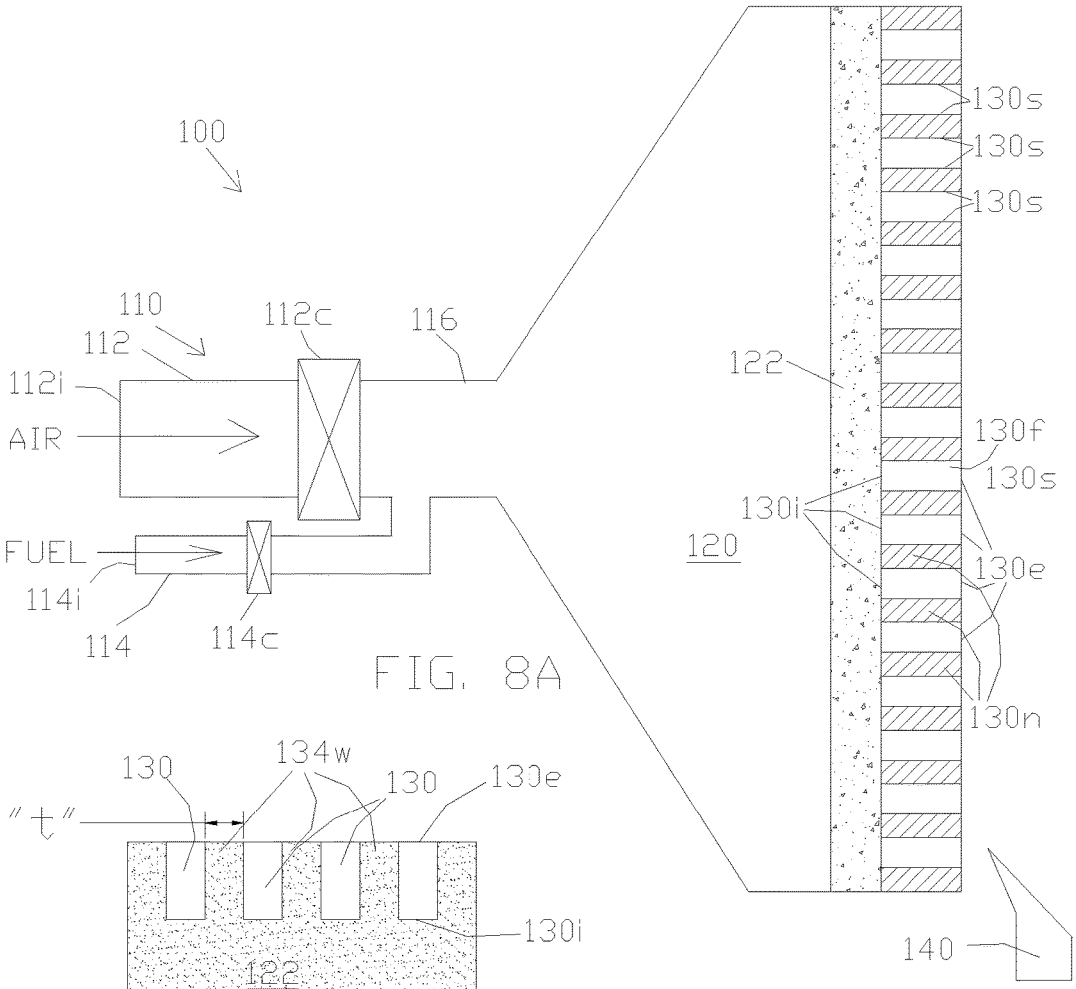
FIG. 8A represents an aphlogistic burner 100 which is useful as a space heater.

FIG. 8A represents an aphlogistic burner 100 wherein porous structure 122 is located at the inlets 130*i* of a very large plurality of RCZs 130 (Similar to the aphlogistic burner of FIG. 7) having very small cross-sectional areas and very short axial lengths. For example, structured ceramic packing with very small cells (such as those available commercially from suppliers such as Lantec Inc. of Agoura Hills, Calif. —www.lantecp.com) could be cut to very short lengths to create tiles with axial flow passages that could function as miniature RCZs in the aphlogistic burner 100 of FIG. 8A. These tiles can be tiled to provide a large surface area which acts as a radiant surface when aphlogistic burner 100 of FIG. 8A is in operation. As described above, porous structure 122 functions as a combustion guard. The operation of aphlogistic burner 100 of FIG. 8A is similar to that described above for the aphlogistic burners of FIG. 3B and FIG. 7. Aphlogistic burner 100 of FIG. 8A can be used for space heating or comfort heating or any other application wherein radiant heating is required.

Figure 8B:
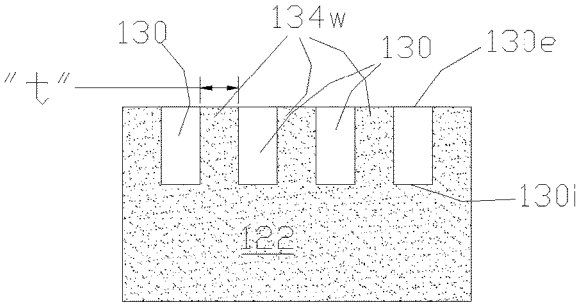
FIG. 8B shows another embodiment of a porous structure that could be used as Radiant Combustion Zone 130 in aphlogistic burner 100 of FIG. 8A.
Figure 8C:
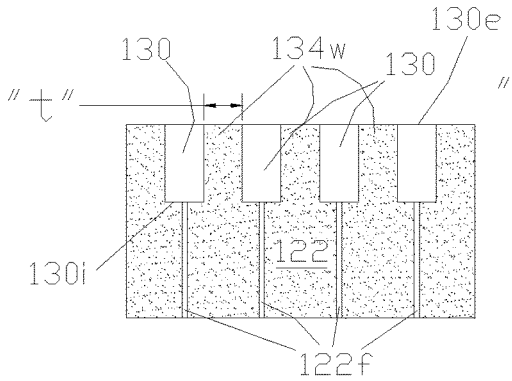
FIG. 8C shows yet another embodiment of a porous structure that could be used as Radiant Combustion Zone 130 in aphlogistic burner 100 of FIG. 8A.
Figure 8D:
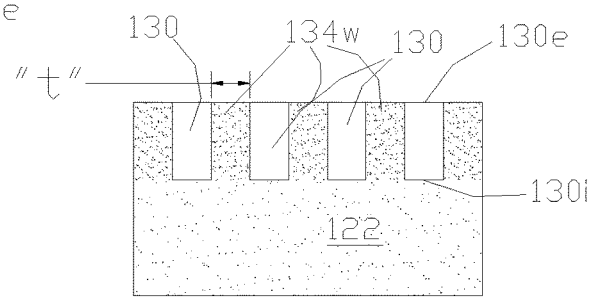
FIG. 8D shows yet another embodiment of a porous structure that could be used as Radiant Combustion Zone 130 in aphlogistic burner 100 of FIG. 8A.

FIG. 8B to 8D show various other embodiments of porous structures that could be used as RCZ 130 in aphlogistic burner 100 of FIG. 8A. As an alternate embodiment, in FIG. 8B, porous structure 122 is cast as a unitary porous structure with a homogenous porosity throughout its volume. RCZs 130 are configured as cavities on the fluid outlet face of porous structure 122. Thus the upper cavitied section of porous structure 122 functions as miniature RCZs and the lower non-cavitied section of porous structure 122 functions as a combustion guard.

In the embodiment of the porous structure 122 shown in FIG. 8C, feed passages 122*f* are provided within porous structure 122 to feed the fuel-air mixture into the cavities in porous body 122. This provides more uniform feed to the cavities with a lower pressure drop.

In another embodiment of the porous structure 122 shown in FIG. 8D, the porosity of the combustion guard section of porous structure 122 is less than the porosity of the cavitied section of porous structure 122 to reduce pressure drop and provide a uniform flow of the fuel-air mixture into RCZs 130. Modifications such as a tapered combustion zone, etc. as described previously can also be incorporated in this embodiment.

Yet other structures are possible for use as porous structure 122. Such structures and modifications to above described structures will be obvious to persons having ordinary skills in the art.

In the above described embodiments, the internal surfaces of the cavities act as IR radiation reflectors reflecting IR radiation from the surfaces back into the fuel-air mixture. Thereby cavities in porous structure 122 essentially function as flameless non-surface combustion cells. In simple terms, flameless non-surface combustion cells are essentially cavities on the radiation producing face of burner 100. The cavities are designed to be large enough to cause the flame to retract back to the combustion section of porous structure 122. The containment of the flame within the cavities assures rapid heating of the miniature RCZs to attain the auto-ignition temperature of the gaseous fuel-air mixture which, as described above, permeates or flows into the cavities from AFMM 120 through the combustion guard. If the cavities are too small to prevent flameback from occurring, the heating of the miniature RCZs will depend on glow back only. In such a case, the heating of the miniature RCZs will be much slower or may be inadequate to cause auto-ignition of the fuel to occur within the cavities when using natural gas as a fuel. The applicant has experimentally determined that a cavity cross-sectional dimension of about 4-mm (0.15 inch) is very adequate to promote rapid flameback within the cavity to cause auto-ignition of the fuel to occur within the cavity.

The wall thickness "t" (shown in FIGS. 8B to 8D) between adjacent cavities only needs to be enough to provide a rugged burner element. Excess wall material will only restrict air and gas flow on a burner diameter basis. The additional wall material also will increase the time required to heat the cavities to auto-ignition temperature. A flameless combustion cell wall thickness "t" of about 1 mm or less will provide good strength if a good ceramic material is chosen and will heat up in several seconds.

The material of construction of porous structure 122 should provide good strength at all temperatures, good tolerance to thermal shock, and have a high emissivity. The material of construction of porous structure 122 also should be unaffected chemically by the products of combustion of the fuel.

While the cavities have been shown as elongated passages in the above figures, they could have any suitable configuration.

It is contemplated that the above described embodiments of aphlogistic burner 100 of FIGS. 1A to 8A would function also to burn-off completely the fine carbon particles, recondensed hydrocarbon particles or soot that is generally produced during the combustion of a fuel. Thus the above described embodiments of aphlogistic burner 100 would be a cleaner burner which creates very little and possibly no particulate pollution.

While all of the above embodiments of aphlogistic burner 100 described above are shown with a straight flow through flow passage 130*f* which functions as the RCZ 130, it will be obvious to persons skilled in the art that flow passage 130 could have any suitable configuration, which could include bends and turns and other flow re-directions.

Figure 9A:
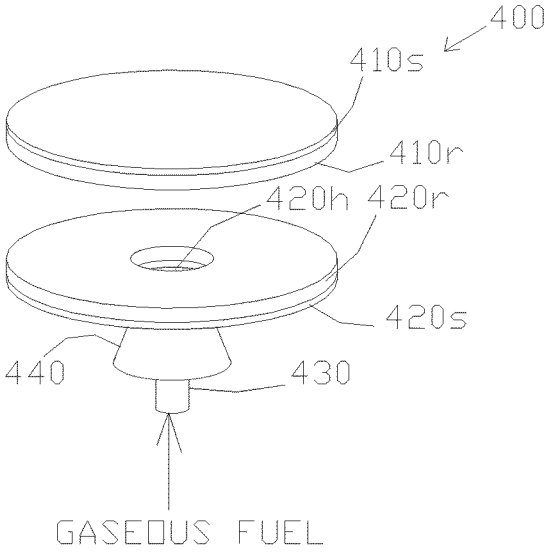
FIG. 9A is an isometric exploded-view representation of an embodiment of an aphlogistic No-NOx burner element that has an attached extended radially configured radiant combustion chamber.
Figure 9B:
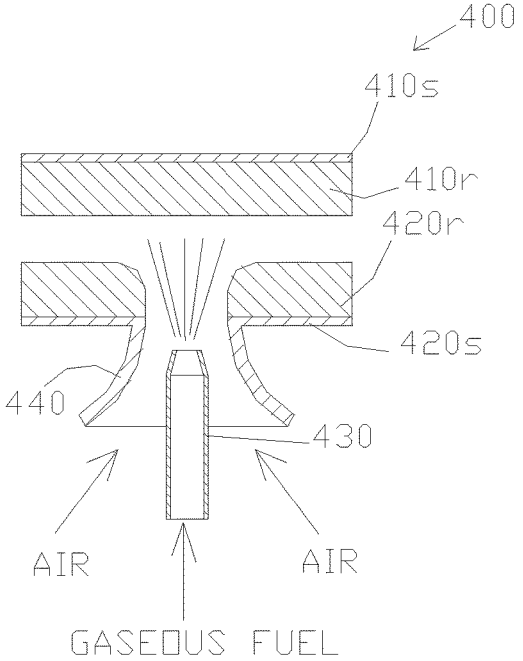
FIG. 9B is a longitudinal elevation representation of the burner of FIG. 9A.

For example, FIG. 9A is an isometric exploded-view representation of an embodiment of an aphlogistic No-NOx burner 400 that has an attached extended radially configured radiant non-surface combustion chamber. FIG. 9B is a longitudinal elevation representation of the burner of FIG. 9A. This burner is similar to the burner of FIG. 1B except that the combustion chamber is ring-shaped rather than cylindrical shaped. The combustion chamber comprises an upper disc 410*s* and a lower washer-shaped disc 420*s*. The outer diameter of disc 420*s* matches the outer diameter of disc 410*s*. Ceramic insulation 410*r* and 420*r* is provided on the opposing faces of discs 410*s* and 420*s*. A venturi-shaped air inlet 440 is attached to the opening 420*h* of disc 420*s* at its non-opposing face. A gaseous fuel nozzle 430 is located within air inlet 440. When the gaseous fuel is directed into air inlet 440, venturi action induces ambient air into air inlet 440. The air-fuel mixture enters the radiant combustion zone (RCZ) between discs 410*s* and 420*s* wherein the fuel is combusted. The hot flue gases flow out radially along the circumference of discs 420*s* and 410*s*. Because non-surface combustion takes place in the radiant zone, there will be no production of NOx in this burner if operated correctly.

To increase the surface area within the RCZ, ribs, bumps and other perturbations can be molded into the ceramic insulation 410*r* and 420*r*. Yet other means of adding surface area within the RCZ could be considered also. Furthermore, the perturbations can be designed to provide a swirling movement to the flue gases as they exit the circumferential outlet of the burner. This arrangement may be particularly useful for domestic hot water heaters wherein the swirl will ensure even heating and heat transfer in the lower section below the hot water tank. The swirl will also accelerate as it enters the central pipe within the hot water heater tank. The high angular velocity will enhance heat transfer in this central pipe.

Figure 9C:
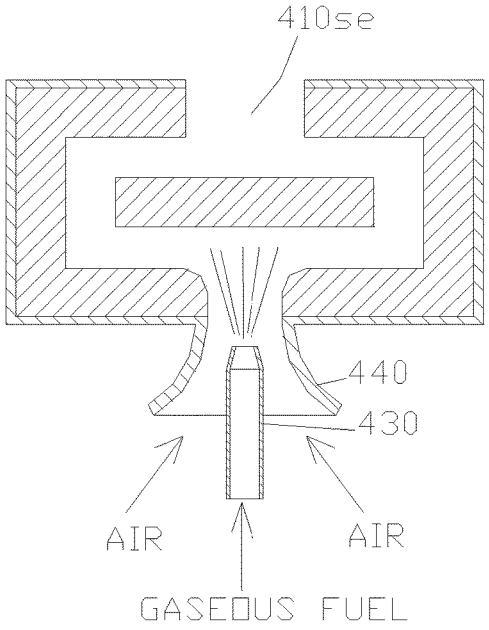
FIG. 9C shows a variation of the burner of FIG. 9B wherein the hot products of combustion are vented through a centered exhaust 410*se*.

FIG. 9C shows a variation of the aphlogistic burner of FIG. 9B wherein the hot products of combustion are vented through a centered exhaust 410*se*. This arrangement provides focussed heating which is useful in many applications such as cooking stoves, boilers, scrap metal melting pots, etc.

Figure 9D:
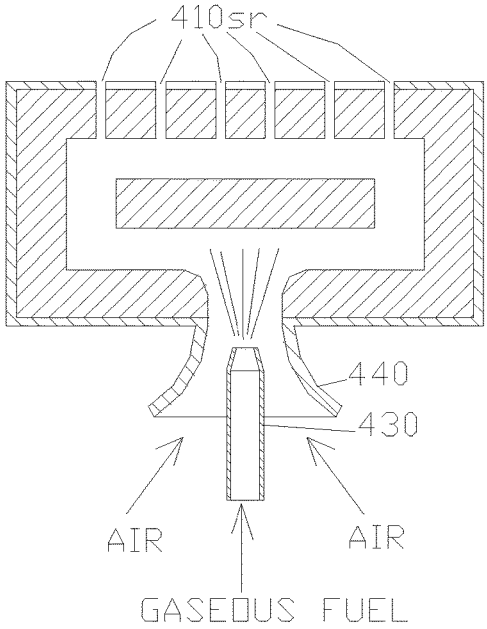
FIG. 9D shows another variation of the burner of FIG. 9B wherein the hot products of combustion are vented through multiple orifices 410*sr*.

FIG. 9D shows another variation of the aphlogistic burner of FIG. 9B wherein the hot products of combustion are vented through multiple orifices 410*sr*.

Figure 10:
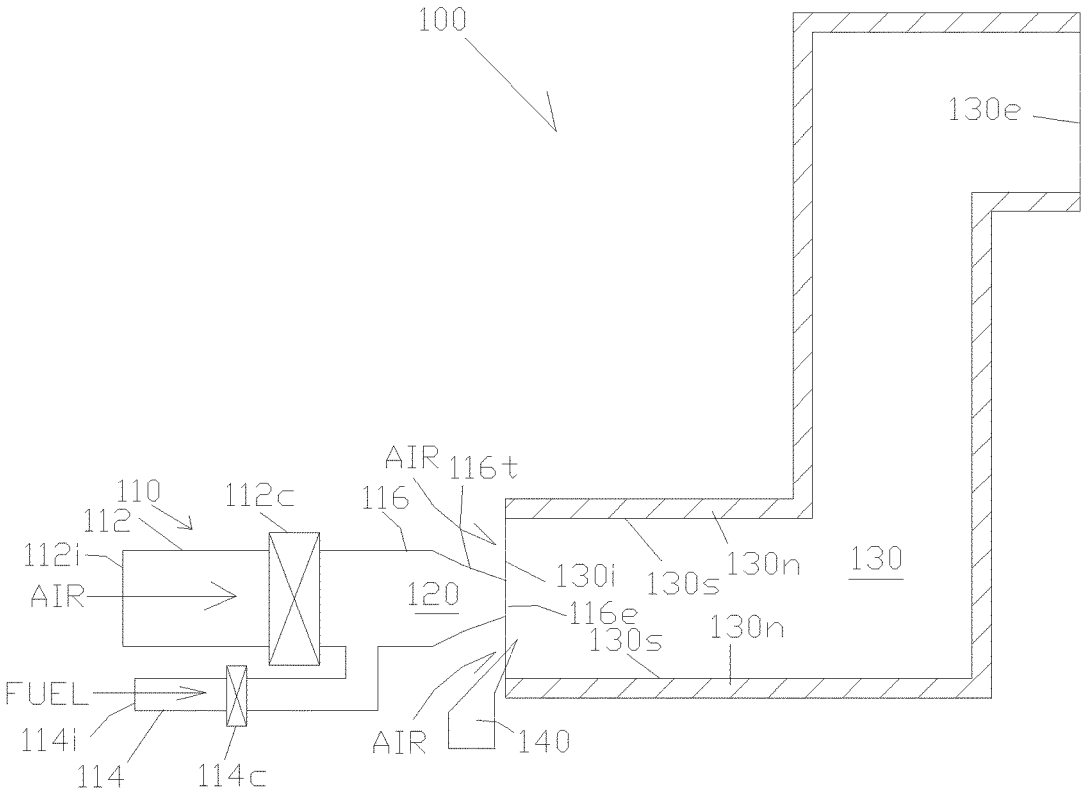
FIG. 10 represents another embodiment of aphlogistic burner 100 wherein the Radiant Combustion Zone has two right angle bends which further facilitates the containment of the infra-red radiation within Radiant Combustion Zone 130 to promote flameless combustion with zero-NOx and zero-CO.

As another example, FIG. 10 represents another embodiment of aphlogistic burner 100 wherein RCZ 130 has two right angle bends which further facilitates the containment of the IR radiation within RCZ 130 to promote flameless non-surface combustion with zero-NOx and zero-CO. The operation of aphlogistic burner 100 of FIG. 10 follows the operation described above for aphlogistic burner 100 of FIG. 1A.

While the above description contains many specific details, these details should not be construed as limiting the scope of the embodiment but merely as providing illustrations of several possible embodiments. For example, the combustion guard is shown as tapered nozzles in the above described figures. However, it will be quite obvious that the combustion guard could be designed with various other physical configurations which would provide a high velocity to the fuel-air mixture prior to its introduction into the RCZ. For example, the combustion guard could be designed as a straight-through high velocity tube. Alternatively, the combustion guard could be designed as a constricted tube, for example, with an orifice shaped constriction, or with a venturi shaped constriction for low pressure drop. Other designs of the combustion guard could include tubes with high velocity bends. These and other such variations to the design of the combustion guard will be obvious to persons having ordinary skill in the art. Therefore, the scope of the embodiments should be determined by the following claims and their legal equivalents rather than by the examples described herein.

I claim:

1. An Aphlogistic burner capable of zero-NOx and zero-CO operation which comprises:

an Air-Fuel Ratio Attainment Means (AFRAM) connected to a source of fuel and to a source of air, the Air-Fuel Ratio Attainment Means having means to achieve the required proportions of fuel and air therethrough;

an Air-Fuel Mixing Means (AFMM) in fluid communication with the Air-Fuel Ratio Attainment Means to thoroughly mix the air and fuel to provide a readily combustible mixture, the Air-Fuel Mixing Means further comprising a supply plenum;

a Radiant Combustion Zone (RCZ), the Radiant Combustion Zone comprising one or more flow passages having a fluid flow inlet in fluid communication with the supply plenum of the Air-Fuel Mixing Means and a hot gas discharge opening, the Radiant Combustion Zone providing the intense radiant energy required to initiate and substantially complete and promote and enhance an oxidation reaction between the fuel and oxygen, the oxidation reaction taking place away from a containing surface and within a gas envelope of the fuel and air mixture and a Combustion Initiation Means (CIM) located in a combustion-initiation-contact position to initiate and substantially complete the combustion in the Radiant Combustion Zone.

2. The Aphlogistic burner of claim 1 wherein the fluid communication between the supply plenum of the Air-Fuel Mixing Means and the Radiant Combustion Zone is provided by one or more high velocity fluid flow passages, each passage having a cross-sectional flow area sufficient to create a gas velocity greater that the flame velocity to prevent pre-ignition in the supply plenum of the Air-Fuel Mixing Means.

3. The Aphlogistic burner of claim 1 further comprising a flow permeable structure located in the fluid flow inlet of the Radiant Combustion Zone to prevent pre-ignition in the supply plenum of the Air-Fuel Mixing Means.

4. The Aphlogistic burner of claim 3 wherein the flow permeable structure has through flow passages.

5. The Aphlogistic burner of claim 3 wherein the flow permeable structure is a ceramic honeycomb with through flow passages.

6. The Aphlogistic burner of claim 3 wherein the flow permeable structure is a porous ceramic structure with random through flow passages.

7. The Aphlogistic burner of claim 3 wherein the flow permeable structure is a wire mesh structure.

8. The Aphlogistic burner of claim 2 further comprising an infrared radiation reflector in the Radiant Combustion Zone which is located proximate to or at the flow discharge opening of the Radiant Combustion Zone to intensify the infrared radiation in the Radiant Combustion Zone.

9. The Aphlogistic burner of claim 3 further comprising an infrared radiation reflector in the Radiant Combustion Zone and located proximate or at the flow discharge opening of the Radiant Combustion Zone to intensify the infrared radiation in the Radiant Combustion Zone.

10. The Aphlogistic burner of claim 9 wherein the infrared radiation reflector is a porous flow permeable structure.

11. The Aphlogistic burner of claim 9 wherein the infrared radiation reflector is a peripheral flow baffle.

12. The Aphlogistic burner of claim 4 further comprising an infrared radiation reflector in the Radiant Combustion Zone and located at or proximate the flow discharge opening of the Radiant Combustion Zone to intensify the infrared radiation in the Radiant Combustion Zone.

13. The Aphlogistic burner of claim 12 wherein the infrared radiation reflector is a porous flow permeable structure.

14. The Aphlogistic burner of claim 12 wherein the infrared radiation reflector is a peripheral flow baffle.

15. The Aphlogistic burner of claim 5 further comprising an infrared radiation reflector in the Radiant Combustion Zone and located proximate or at the flow discharge opening of the Radiant Combustion Zone to intensify the infrared radiation in the Radiant Combustion Zone.

16. The Aphlogistic burner of claim 15 wherein the infrared radiation reflector is a porous flow permeable structure.

17. The Aphlogistic burner of claim 15 wherein the infrared radiation reflector is a peripheral flow baffle.

18. The Aphlogistic burner of claim 6 further comprising an infrared radiation reflector in the Radiant Combustion Zone and located proximate or at the flow discharge opening of the Radiant Combustion Zone to intensify the infrared radiation in the Radiant Combustion Zone.

19. The Aphlogistic burner of claim 18 wherein the infrared radiation reflector is a porous flow permeable structure.

20. The Aphlogistic burner of claim 18 wherein the infrared radiation reflector is a peripheral flow baffle.

21. The Aphlogistic burner of claim 7 further comprising an infrared radiation reflector in the Radiant Combustion Zone and located proximate or at the flow discharge opening of the Radiant Combustion Zone to intensify the infrared radiation in the Radiant Combustion Zone.

22. The Aphlogistic burner of claim 21 wherein the infrared radiation reflector is a porous flow permeable structure.

23. The Aphlogistic burner of claim 21 wherein the infrared radiation reflector is a peripheral flow baffle.

24. The Aphlogistic burner of claim 1 wherein the Radiant Combustion Zone is configured as a flat, hollow disc which comprises:

a flat bottom which contains the fluid flow inlet for fluid communication with the supply plenum of the Air-Fuel Mixing Means;

a flat top;

a cylindrical wall; and the hot gas discharge opening is a plurality of orifices on the cylindrical wall of the hollow disc.

25. The Aphlogistic burner of claim 24 wherein the Air-Fuel Ratio Attainment Means comprises an air eductor.

26. The Aphlogistic burner of claim 1 wherein the Radiant Combustion Zone is configured as a flat, hollow disc which comprises:

a flat bottom which contains the fluid flow inlet for fluid communication with the supply plenum of the Air-Fuel Mixing Means;

a flat top;

a cylindrical wall;

a target baffle located within the hollow disc in the flow-path of the combustible mixture; and the hot gas discharge opening is an opening in the flat top of the hollow disc.

27. The Aphlogistic burner of claim 26 wherein the Air-Fuel Ratio Attainment Means comprises an air eductor.

28. An Aphlogistic burner capable of zero-NOx and zero-CO operation which comprises:

an Air-Fuel Ratio Attainment Means (AFRAM) connected to a source of fuel and to a source of air, the Air-Fuel Ratio Attainment Means having means to achieve the required proportions of fuel and air therethrough;

an Air-Fuel Mixing Means (AFMM) in fluid communication with the Air-Fuel Ratio Attainment Means to thoroughly mix the air and fuel to provide a readily combustible mixture, the Air-Fuel Mixing Means further comprising a supply plenum;

a plurality of Radiant Combustion Zones (RCZs), each of the Radiant Combustion Zone comprising one or more flow passage having a fluid flow inlet in fluid communication with the supply plenum of the Air-Fuel Mixing Means and a hot gas discharge opening, the Radiant Combustion Zone providing the intense radiant energy required to initiate and substantially complete and promote and enhance oxidation reactions between the fuel and oxygen, the oxidation reactions taking place away from a surface of the flow passages and within a gas envelope of the fuel and air mixture without the creation of a visible flame;

and a Combustion Initiation Means (CIM) located in combustion-initiation-contact position with the Radiant Combustion Zones to initiate and substantially complete the combustion in the Radiant Combustion Zones.

29. The Aphlogistic burner of claim 1, wherein the burner uses natural gas as a fuel and the Air-Fuel Ratio Attainment Means produces an air-natural gas fuel mixture having an air-fuel ratio greater than or equal to 10 and less than or equal to 22.

* * * * *